US007497641B1

(12) United States Patent
Frelich

(10) Patent No.: US 7,497,641 B1
(45) Date of Patent: Mar. 3, 2009

(54) PAVING MACHINE HAVING ADJUSTABLE BALLAST SYSTEM AND METHOD

(75) Inventor: Toby Frelich, Saint Michael, MN (US)

(73) Assignee: Caterpillar Paving Products Inc., Minneapolis, MN (US)

( * ) Notice: Subject to any disclaimer, the term of this patent is extended or adjusted under 35 U.S.C. 154(b) by 0 days.

(21) Appl. No.: 11/973,742

(22) Filed: Oct. 10, 2007

(51) Int. Cl.
*E01C 19/22* (2006.01)
*A01B 35/32* (2006.01)

(52) U.S. Cl. ..... 404/130; 172/611

(58) Field of Classification Search ..... 404/130, 404/131, 118; 172/611
See application file for complete search history.

(56) References Cited

U.S. PATENT DOCUMENTS

| | | | | | |
|---|---|---|---|---|---|
| 2,763,385 | A | | 9/1956 | Harrison | |
| 2,916,232 | A | | 12/1959 | Schramm | |
| 3,402,649 | A | | 9/1968 | Guntert | |
| 3,602,115 | A | | 8/1971 | Hanson | |
| 3,616,730 | A | * | 11/1971 | Boone et al. | 404/117 |
| 3,741,145 | A | | 6/1973 | Braddon | |
| 3,743,322 | A | | 7/1973 | Sherrod | |
| 3,900,272 | A | * | 8/1975 | Domenighetti | 404/130 |
| 3,969,035 | A | * | 7/1976 | Silbernagel | 404/98 |
| 4,018,541 | A | * | 4/1977 | Denikin et al. | 404/130 |
| 4,151,921 | A | | 5/1979 | Myers et al. | |
| 4,299,530 | A | | 11/1981 | Schaeff | |
| 4,322,094 | A | * | 3/1982 | Bobard | 280/755 |
| 4,861,069 | A | * | 8/1989 | Gunter | 280/758 |
| 5,156,215 | A | | 10/1992 | Jensen | |
| 5,309,857 | A | | 5/1994 | Brosseuk | |
| 5,685,563 | A | | 11/1997 | Ottestad | |
| 5,993,110 | A | * | 11/1999 | Bueno | 404/130 |

FOREIGN PATENT DOCUMENTS

DE 299 20 556 U1 3/2000

* cited by examiner

*Primary Examiner*—Raymond W Addie
(74) *Attorney, Agent, or Firm*—Liell & McNeil

(57) ABSTRACT

A paving machine includes a frame having a hopper, a screed and a conveyor to transfer paving material between the hopper and the screed. A ballast system of the paving machine includes an actuator configured to adjust a movable ballast such as a liquid ballast to switch the paving machine between ballast states corresponding to different operating configurations thereof.

19 Claims, 2 Drawing Sheets

PAVING MACHINE HAVING ADJUSTABLE BALLAST SYSTEM AND METHOD

TECHNICAL FIELD

The present disclosure relates generally to paving machines and methods, and relates more particularly to switching a paving machine between different ballast states to accommodate different machine operating configurations.

BACKGROUND

A variety of different paving machines are used in construction and related industries for depositing a mat of paving material, typically an asphalt material, on a work surface. Such machines are usually self-propelled, and include a receptacle for paving material, a screed for distributing and compacting the paving material on a work surface, and a conveyor which transfers paving material from the receptacle to the screed. One feature common to most types of paving machines is an adjustable support apparatus for the screed which is coupled with a frame of the paving machine and can be used to elevate the screed from a lowered, paving position to a higher position for transport. Since part of the function of screeds is to compact paving material, they are typically relatively heavy. Screeds are often 25% or more of the total weight of an associated paving machine. In the lowered position, much of the weight of the screed is supported by the work surface, riding or "floating" on the paving material distributed by the paving machine. When in the raised position, the screed does not rest on the work surface and its full weight is typically borne by the support apparatus.

When a paving machine is adjusted from a state at which the screed is lowered to a state at which the screed is raised, a center of gravity of the paving machine can change significantly. In particular, when the screed is lowered, and much or all of its weight supported by the work surface, the center of gravity of the paving machine tends to be relatively further forward. This phenomenon is generally opposite to what is desirable, as weight toward the back end could improve traction when the screed is lowered. When the screed is raised, the center of gravity tends to move towards the back of the machine. This is also generally opposite to what is desirable, as machine stability can suffer, hindering travel and possibly violating jurisdictional requirements for public roads and the like.

In an effort to design a machine which can reliably have sufficient traction for paving, but also stability for driving the machine when not paving, engineers have typically added extra weight strategically at certain locations on the paving machine. It is common for back tires of a paving machine to be filled with liquid, such as water, propylene glycol, etc. Solid steel plates may also be affixed to paving machines at locations towards their front end. Adding extra, fixed mass can lessen the extent to which the center of gravity changes when moving the screed between a raised position and a lowered position, and can help ensure that sufficient weight remains in appropriate positions in different machine states. While these strategies have been successful, there remains ample room for improvement.

The present disclosure is directed to one or more of the problems or shortcomings set forth above.

SUMMARY

In one aspect, a paving machine includes a frame having a hopper, a screed and a conveyor configured to transfer a paving material from the hopper to the screed. The paving machine also includes ground engaging elements mounted to the frame, and a ballast system having a first ballast state for operating the paving machine in a first operating configuration and at least one other ballast state for operating the paving machine in a second operating configuration. The ballast system includes an actuator configured to adjust a movable ballast to switch between the ballast states.

In another aspect, a method of operating a paving machine having a frame with a hopper, a screed and a conveyor configured to transfer a paving material from the hopper to the screed is provided. The method includes the steps of adjusting the paving machine between a first operating configuration and a second operating configuration, and commanding switching the paving machine between a first ballast state corresponding to the first operating configuration and a second ballast state corresponding to the second operating configuration.

In still another aspect, a ballast system for a paving machine having a frame with a hopper, a screed and a conveyor configured to transfer a paving material from the hopper to the screed includes a first ballast support element configured to mount to the frame of the paving machine at a first location, and a second ballast support element configured to mount to the frame of the paving machine at a second location. The ballast system further includes an actuator configured to adjust a movable ballast between the ballast support elements to switch the paving machine between a first ballast state for operating the paving machine in a first operating configuration and a second ballast state for operating the paving machine in a second operating configuration.

DETAILED DESCRIPTION

Figure 1:
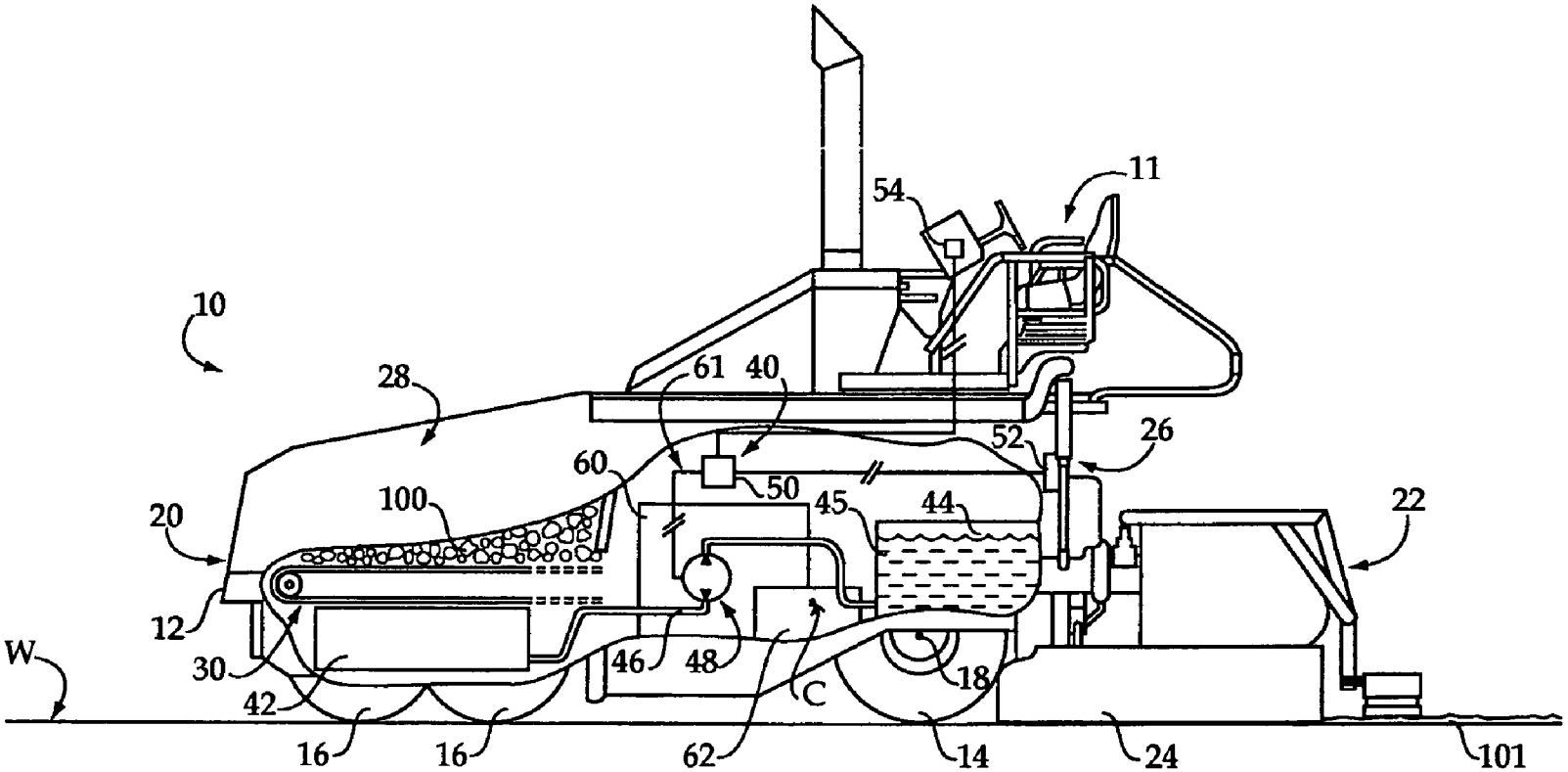
FIG. 1 is a partially open side diagrammatic view of a paving machine according to one embodiment, in a first operating configuration.

Referring to FIG. 1, there is shown a paving machine 10 according to one embodiment. Paving machine 10 may be a self-propelled machine having a frame 12 with a set of back ground engaging elements 14 and a set of front engaging elements 16 coupled therewith. An engine 60 is provided, and is configured for powering back ground engaging elements 14 via interaction with a drive axle 18. A fuel tank 62 is provided and supplies a fuel to engine 60 in a conventional manner. In one embodiment, engine 60 and fuel tank 62 may be disposed in an engine compartment 61 in a generally conventional arrangement. A hydrostatic drive system (not shown) may be coupled with engine 60 for powering back drive axle 18 in some embodiments. In the FIG. 1 illustration, ground engaging elements 16 and 14 comprise ground engaging wheels including, for example, rubber tires, however, it should be appreciated that the present disclosure is also applicable to paving machines utilizing a set of ground engaging tracks, or some other drive arrangement. Machine 10 may further include a front end 20 and a back end 22. A hopper 28 for storing a paving material 100 may be positioned adjacent front end 20, whereas a screed 24 may be positioned adjacent back end 22. A conveyor system 30 is mounted to frame 12 and configured to convey paving material 100 from hopper 28 to screed 24, in a conventional manner.

Screed 24 may be adjustable from a first, lowered position, to a raised position. An operator station 11 is mounted on frame 12, and includes a set of screed controls 54, as well as various other machine controls. In one embodiment, screed controls 54 may consist of electronic controls whereby an operator at station 11 can adjust screed 24 between its respective positions relative to frame 12. A screed support apparatus 26, which may include hydraulic or other actuators, may be coupled between screed 24 and frame 12. Thus, screed controls 54 may be adapted to actuate screed support apparatus 26 to adjust screed 24 between its respective positions. It will typically be desirable to position screed 24 in a lowered position, as shown in FIG. 1, during paving. The majority of, and possibly all of, a weight of screed 24 will typically be supported on paving material deposited on a work surface W, via conveyor system 30. As paving machine 10 is moved across/along work surface W, screed 24 can compact the asphalt into a mat 101. It should be appreciated that screed 24 may have only a lowered state, as shown in FIG. 1, and a raised state, but in certain embodiments could have a range of positions between its lowered state and its raised state. Screed 24 might also comprise an extendable width screed to accommodate different paving widths, and could include screed heaters, as well as other subsystems.

Figure 2:
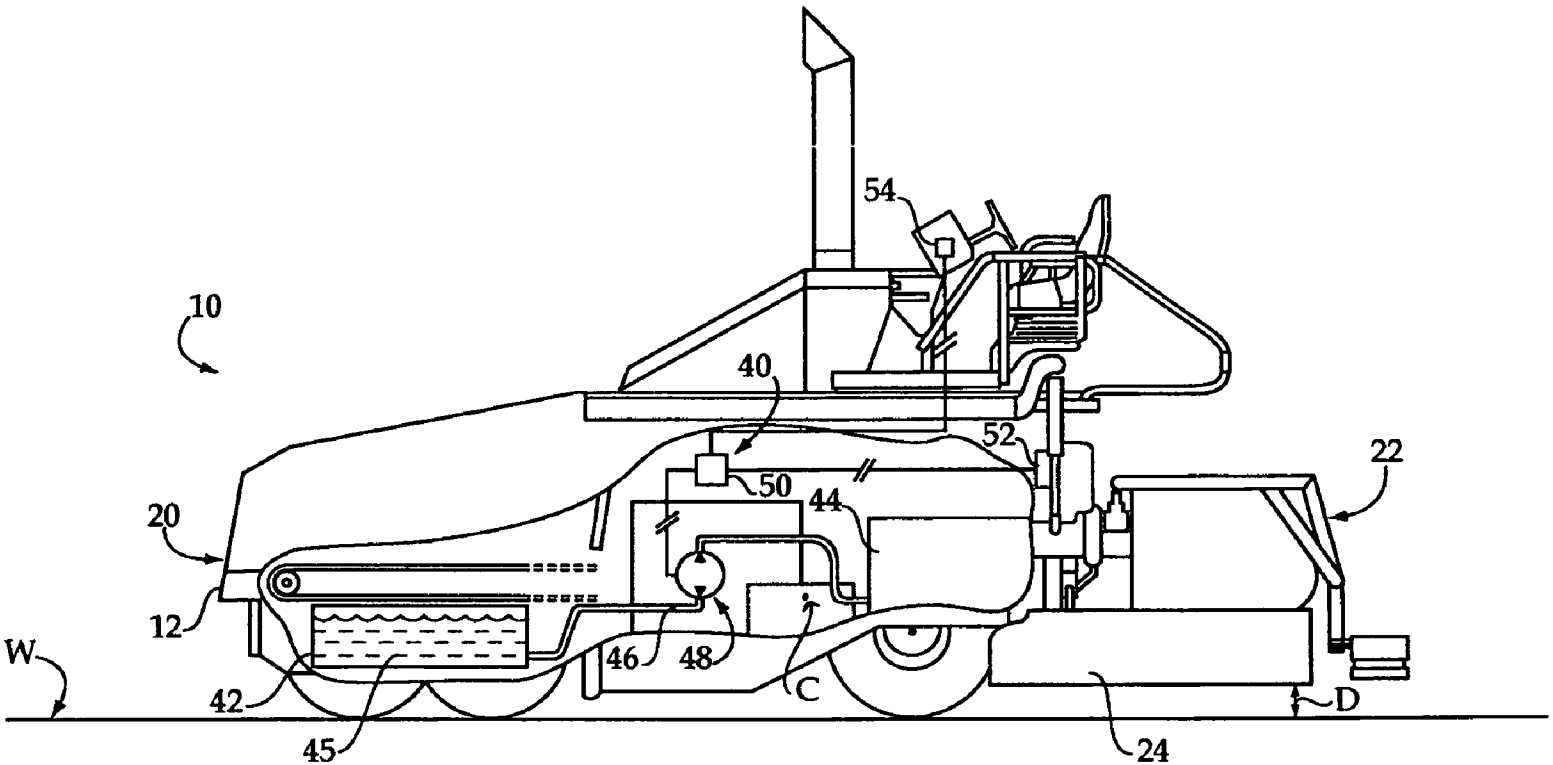
FIG. 2 is a partially open side diagrammatic view of a paving machine according to one embodiment, in a second operating configuration.

When machine 10 is to be transported by driving, for example on a public road, to a different work area or simply onto a transport machine, it will typically be desirable to adjust screed 24 from its lowered position to a raised position. Referring to FIG. 2, there is shown machine 10 in a second operating configuration, wherein screed 24 is raised relative to work surface W. It should be appreciated that the different "operating configurations" described herein are contemplated to be different states of the machine itself, as opposed to one machine state and external factors which are not part of the machine. For example, a machine which has a loaded state, storing a material, and an unloaded state, where it does not store a material, would not fairly be said to be in two different "operating configurations" as that term is intended to be understood herein.

A relative spacing between screed 24 and work surface W is shown via distance D, although it should be appreciated that a "raised" position as contemplated herein could be any position other than one where a maximum weight of screed 24 is resting on a work surface. Thus, actuating support apparatus to support a portion of the weight of screed 24 without lifting screed 24 off of a paving material mat could be a raised position. As discussed above, adjusting a conventional paving machine between a first operating configuration wherein its screed is lowered and a second operating configuration wherein its screed is raised can cause a center of gravity of the machine to shift in a fore-aft direction. The present disclosure provides a unique means for controlling a location of a center of gravity C of machine 10 when screed 24 is adjusted between its relative positions. It should be appreciated that embodiments are contemplated wherein a change in the location of center of gravity C is inhibited, as well as embodiments wherein the location of a center of gravity C changes, as further described herein.

To this end, paving machine 10 includes a ballast system 40 which has a first ballast state for operating machine 10 in a first operating configuration, where screed 24 is lowered, and at least one other ballast state for operating paving machine 10 in a second operating configuration, where screed 24 is raised. Ballast system 40 could also have a range of ballast states, for example corresponding to a relative proportion of the weight of screed 24 which is supported on work surface W. A range of ballast states might also be provided to account for a varying mass of paving material in hopper 28, a mass of on-board fuel in fuel tank 62, etc. In still other instances, ballast system 40 might have ballast states for paving different surfaces, such as uphill surfaces versus downhill surfaces, or sideways slanting surfaces. Each of these conditions might be addressed with different ballast states, and hence different optimum weight distributions for paving machine 10.

Ballast system 40 may include a sensor 52 coupled with screed support apparatus 26 which is configured to sense the state, location, activation, etc., of screed support apparatus 26, or the state, location, or changes therein of screed 24. Sensor 52 might also sense still other factors having a known relationship with screed 24 or screed support apparatus 26 to enable determining whether screed 24 is in its raised position or its lowered position, or being adjusted. An electronic control unit 50 may be coupled with sensor 52 such that it can command switching of ballast system 40 between or among its ballast states to accommodate changes in operating configuration of machine 10 which correspond to changes in the position of screed 24.

Ballast system 40 may thus be adjusted via electronic control unit 50 to control a location of center of gravity C based at least in part on the location of screed 24. It should be appreciated that many different means for determining whether screed 24 is raised or lowered, or being presently adjusted, might be employed. For example, sensor 52 might comprise a position sensor or a flow sensor coupled with a hydraulic cylinder of support apparatus 26. Sensor 52 might also comprise a magnetic sensor coupled with frame 12 which detects a location or movement of a part of screed 24. In still other embodiments, for example where screed controls 54 comprise electronic controls, a control signal from screed controls 54 might be received by electronic control unit 50 and used to responsively command switching ballast system 40 between its ballast states.

In one embodiment, ballast system 40 may include a first ballast support element 42 for supporting a movable ballast positioned at a fore location of frame 12, and a second ballast support element 44 also for supporting the movable ballast, positioned at an aft location of frame 12. The fore location of element 42 may be underneath conveyor system 30, and adjacent front end 20, whereas the aft location of element 44 may be above drive axle 18 and forward of screed 24. In other embodiments, the fore and aft locations might be different from those illustrated in FIGS. 1 and 2. Moreover, rather then two ballast support elements, more than two ballast support elements might be used in other embodiments. Rather than simply moving a movable ballast between a fore location and an aft location, one or more movable ballast elements might be moved side to side in machine 10, or positioned at a range of locations between front end 20 and back end 22. Ballast system 40 might also be actuated in response to weight distribution changes resulting from the change in the amount of paving material in hopper 28 and/or consumption of fuel from fuel tank 62.

In any event, ballast system 40 may include at least one actuator which is configured to adjust a movable ballast between elements 42 and 44. In one embodiment, actuator 48 may comprise a pump such as a bi-directional pump configured to transfer a liquid ballast 45 between element 44 and element 42 via a fluid conduit 46. Actuator 48 may be coupled with control unit 50, such that control unit 50 can command activation of actuator 48 to pump in either of two directions to move liquid ballast 45 between elements 44 and 42. To this end, each of elements 42 and 44 might comprise a liquid reservoir, separate from fuel tank 62, between which liquid ballast 45 is transferred depending upon operating conditions. In other embodiments, multiple pumps positioned in multiple fluid conduits might be used, or a uni-directional pump could be used and the flow direction between elements 42 and 44 reversed via valves, etc.

INDUSTRIAL APPLICABILITY

As discussed above, in FIG. 1 machine 10 is shown in an operating configuration suitable for paving. Screed 24 is in a lowered position, and "floats" on mat 101, compacting the paving material, typically in anticipation of further working via compactors, etc. Conveyor system 30 may be operating to transfer paving material 100 from hopper 28 to screed 24. Liquid ballast 45 is at least predominantly, and possibly completely, within liquid reservoir 44. There are several instances in which it may be desirable to adjust machine 10 from the operating configuration shown in FIG. 1 to the operating configuration shown in FIG. 2. For example, paving machine 10 might complete a section of work surface W to be paved, cease depositing paving material, and travel to another area to begin paving there. Alternatively, paving machine 10 might be adjusted to its second operating configuration, as in FIG. 2, where work has ended on a particular work day, and machine 10 is to be driven to a storage location, loaded onto a truck, etc.

When it is desirable to adjust paving machine 10, an operator at operator station 11 may activate controls 54 to command adjusting of screed 24 from its lowered, paving position to its raised position. Electronic control unit 50 may receive a command to raise screed 24 and responsively output commands to support apparatus 26 or an associated hydraulic control apparatus, for example, to begin raising screed 24. It should also be appreciated that support apparatus 26 might be hydraulically controlled, and screed controls 54 might comprise a control device coupled with a pilot valve, etc. Sensor 52, or another suitable sensing or detection system, may sense the raising of screed 24, and output a corresponding signal to electronic control unit 50. Electronic control unit 50 may receive a signal from sensor 52, and responsively command activation of actuator 48 to begin transitioning liquid ballast 45 from reservoir 44 to reservoir 42.

It will be recalled that raising a screed from a lowered position where it is supported on a work surface to a raised position can cause a location of a center of gravity of a paving machine to shift rearward. In accordance with the present disclosure, transitioning of liquid ballast 45 from reservoir 44 to reservoir 42 can inhibit changing of the location of center of gravity C when screed 24 is raised, or it can change the location of center of gravity C to an optimal location for operating machine 10 with screed 24 raised. For instance, ballast 45 may have a mass which is sufficient to allow moving center of gravity C forward for roading, or the mass of ballast 45 may be such that center of gravity C is moved rearward less than what might otherwise occur by adjusting screed 24 to its raised position. Further still, the mass of ballast 45 might be such that moving it between liquid reservoirs 42 and 44 exactly offsets the change in location of center of gravity C that would otherwise occur by adjusting screed 24 between a lowered position and a raised position. Once screed 24 is raised, as in FIG. 2, and liquid ballast 45 has been pumped to reservoir 42, paving machine 10 will be in a configuration appropriate for traveling over roads. When paving machine 10 is to begin paving once more, the process can generally take place in reverse, pumping liquid ballast 45 back to reservoir 44 and lowering screed 24.

The present disclosure is considered to provide substantial advantages over state of the art paving machines. Rather than loading a paving machine with stationary mass, such as fixed metal plates and the like, the actual weight distribution of the paving machine can be controlled according to need. Accordingly, wasted energy, materials and effort associated with fixed ballast elements is avoided. Further, the use of a ballast system in a paving machine as described herein can facilitate compliance with jurisdictional regulations relating to machine stability for roading and the like.

The present description is for illustrative purposes only, and should not be construed to narrow the breadth of the present disclosure in any way. Thus, those skilled in the art will appreciate that various modifications might be made to the presently disclosed embodiments without departing from the full and fair scope and spirit of the present disclosure. For instance, while the foregoing description emphasizes changing the location of a liquid ballast to accommodate different machine operating configurations, the present disclosure is not thereby limited. For instance, rather than pumping liquid ballast between liquid reservoirs, a solid ballast element might be moved via an actuator between different positions of paving machine 10. In such an embodiment, ballast support elements 42 and 44 might comprise mechanical support elements each configured to support a movable solid ballast at the respective fore and aft locations, or whatever other locations would be deemed appropriate. Moreover, rather than an actuator which is a pump, such as actuator 48, the actuator employed in a solid ballast system might consist of a hydraulic or other extensible actuator. In still further embodiments, rather than a liquid ballast such as water, fuel, propylene glycol, calcium chloride water, etc., a ballast of solid materials having fluidic properties such as ball bearings and the like might be used. Other aspects, features and advantages will be apparent upon an examination of the attached drawings and appended claims.

What is claimed is:

1. A paving machine comprising:

a frame having a hopper, a screed and a conveyor configured to transfer a paving material from said hopper to said screed;

ground engaging elements mounted to said frame; and a ballast system having a first ballast state for operating said paving machine in a first operating configuration and at least one other ballast state for operating said paving machine in a second operating configuration, said ballast system including a first ballast support element, a second ballast support element and a ballast transfer element coupled between the first ballast support element and the second ballast support element, each of the first ballast support element, the second ballast support element and the ballast transfer element being resident on the paving machine, and the ballast system further including an actuator configured to adjust a movable ballast within the paving machine by way of the ballast transfer element between the first ballast support element and the second ballast support element to switch between said ballast states whereby the location of the center of gravity of the paving machine is controlled in the fore and aft direction of the paving machine.

2. The paving machine of claim 1 wherein said screed is movable relative to said frame between a paving position corresponding to a first operating configuration of said paving machine and a roading position corresponding to a second operating configuration of said paving machine, and wherein said ballast system is adapted to control a location of a center of gravity of said paving machine in response to moving said screed between said paving position and said roading position.

3. The paving machine of claim 2 wherein said ballast system further comprises a sensor having an output indicative of at least one of, an operating configuration and a change in an operating configuration, of said paving machine and a control device which is configured to control said actuator based at least in part on an output of said sensor.

4. The paving machine of claim 2 wherein:

said machine includes a front end and a back end;

said first ballast support element is positioned at an aft location of said frame and said second ballast support element is positioned at a fore location of said frame.

5. The paving machine of claim 4 wherein:

said ballast system comprises a liquid ballast distribution system and said first and second support elements comprise a first and a second liquid reservoir for a liquid ballast; and said actuator comprises a pump configured to transfer the liquid ballast between said first and second reservoirs when switching between said ballast states.

6. The paving machine of claim 5 wherein:

said paving machine includes a back drive axle coupled with said ground engaging elements and said hopper is positioned forward of said back drive axle; and said aft location is above said back drive axle and forward of said screed, and said fore location is underneath said conveyor.

7. The paving machine of claim 6 wherein said ground engaging elements comprise ground engaging wheels.

8. The paving machine of claim 5 comprising a fuel tank which is separate from said first and second liquid reservoirs.

9. A method of operating a paving machine having a frame with a hopper, a screed and a conveyor configured to transfer a paving material from the hopper to the screed, the method comprising the steps of:

adjusting the paving machine between a first operating configuration and a second operating configuration;

commanding switching the paving machine between a first ballast state corresponding to the first operating configuration, and a second ballast state corresponding to the second operating configuration;

wherein the step of commanding further includes a step of commanding adjusting a movable ballast between a first ballast support element and a second ballast support element within the paving machine by way of a ballast transfer element coupled between the first ballast support element and the second ballast support element, the first ballast support element, the second ballast support element and the ballast transfer element each being resident on the paving machine whereby the location of the center of gravity of the paving machine is controlled in the fore and aft direction of the paving machine.

10. The method of claim 9 further comprising a step of controlling a location of a center of gravity of the paving machine at least in part via the commanding step.

11. The method of claim 10 wherein the adjusting step includes a step of moving the screed between a lowered paving position and a raised roading position.

12. The method of claim 11 wherein the step of controlling a location of a center of gravity of the paving machine includes moving a ballast between a fore location and an aft location of the paving machine.

13. The method of claim 12 wherein the commanding step includes outputting an actuator control command to an actuator of a ballast system of the paving machine which is configured to adjust the movable ballast between the fore location and the aft location.

14. The method of claim 13 wherein the commanding step includes outputting a pump activation command to a bi-directional pump of the ballast system, and wherein the controlling step includes transferring liquid ballast between a first liquid reservoir at the fore location and a second liquid reservoir at the aft location.

15. The method of claim 13 further comprising a step of sensing at least one of, an operating configuration of the paving machine, and a change in an operating configuration of the paving machine.

16. A ballast system for a paving machine having a frame with a hopper, a screed and a conveyor configured to transfer a paving material from the hopper to the screed, said ballast system comprising:

a first ballast support element configured to mount to the frame of the paving machine at a first location;

a second ballast support element configured to mount to the frame of the paving machine at a second location;

a ballast transfer element configured to couple between the first ballast support element and the second ballast support element when mounted to the frame and having a first end connecting with the first ballast support element and a second end connecting with the second ballast support element; and an actuator configured to adjust a movable ballast between the ballast support elements within the paving machine by way of the ballast transfer element to switch the paving machine between a first ballast state for operating the paving machine in a first operating configuration and a second ballast state for operating the paving machine in a second operating configuration whereby the location of the center of gravity of the paving machine is controlled in the fore and aft direction of the paving machine.

17. The ballast system of claim 16 further comprising:

a sensor configured to sense at least one of, an operating configuration of the paving machine and a change in an operating configuration of the paving machine; and a control device configured to output control signals to said actuator in a manner which is responsive to inputs from said sensor.

18. The ballast system of claim 16 wherein said actuator comprises a bi-directional pump.

19. The ballast system of claim 18 wherein said first and second ballast support elements comprise liquid reservoirs which are configured to mount to the frame of the paving machine at a fore location and an aft location, respectively, and are fluidly connected with said bi-directional pump.

* * * * *